United States Patent [19]

Radek

[11] 4,185,422

[45] Jan. 29, 1980

[54] FREE STANDING WALL

[75] Inventor: John R. Radek, Hinsdale, Ill.

[73] Assignee: Ready Metal Manufacturing Company, Chicago, Ill.

[21] Appl. No.: 838,962

[22] Filed: Oct. 3, 1977

[51] Int. Cl.[2] ..... E04B 2/82

[52] U.S. Cl. ..... 52/36; 52/239; 52/288; 52/656

[58] Field of Search ..... 52/36, 239, 280, 288, 52/656

[56] References Cited

U.S. PATENT DOCUMENTS

| | | | |
|---|---|---|---|
| 2,994,413 | 8/1961 | Levy et al. | 52/36 |
| 3,101,817 | 8/1963 | Radek | 52/36 X |
| 3,272,582 | 9/1966 | Anderson et al. | 52/280 X |
| 3,416,270 | 12/1968 | McHugh | 52/280 X |
| 3,513,606 | 5/1970 | Jones | 52/239 X |
| 3,712,003 | 1/1973 | Hallock et al. | 52/288 X |

FOREIGN PATENT DOCUMENTS

| | | | |
|---|---|---|---|
| 1311348 | 10/1962 | France | 52/239 |

*Primary Examiner*—J. Karl Bell

*Attorney, Agent, or Firm*—Frank H. Marks

[57] ABSTRACT

A wall structure for merchandise display in a retail store or the like that stands free of attachment to any fixed element of the building such as floor, ceiling or wall. The wall of the invention may be set up in a variety of forms such as rectangular, zigzag, linear, polygonal, etc., and comprises in all arrangements uprights providing corner units and spacer struts for supporting display panels. To said uprights are secured by quick-detachable means upper and lower stringers, the interconnecting elements being preferably in the form of simple channel members. The corner units comprise structural shapes with detachable corner covers to enhance appearance. Means for detachably mounting panel members is provided in the form of grooved channel members in opposed, spaced relation on the uprights. An important feature is great reduction in on-site labor, with consequent installation economies, made possible in part by welded units for corners and other upright assemblies to which top and bottom stringers may be quickly assembled and disconnected. In elongated wall structures where added structural support is desired, I provide extended, ceiling attachable uprights.

11 Claims, 15 Drawing Figures

FIG. 1
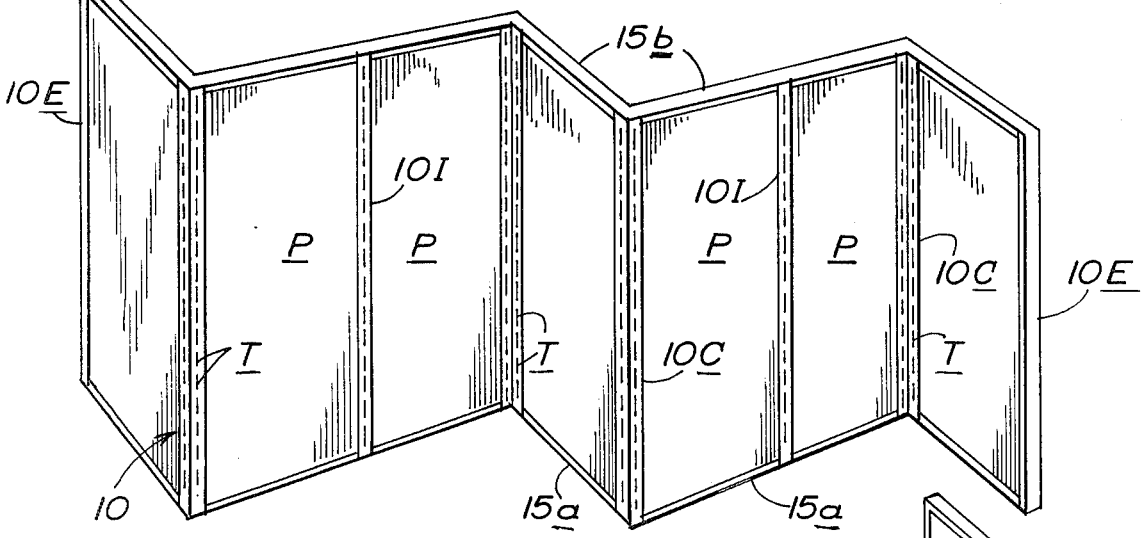
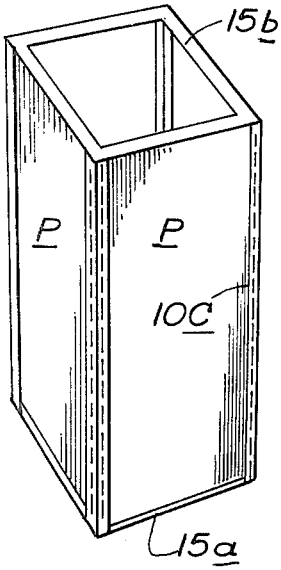
FIG. 2
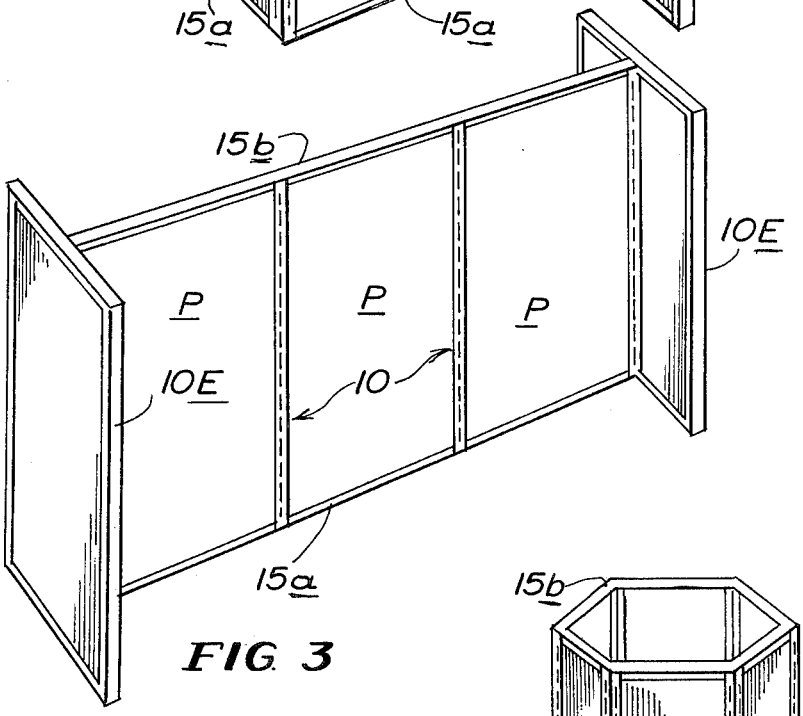
FIG. 3
FIG 4
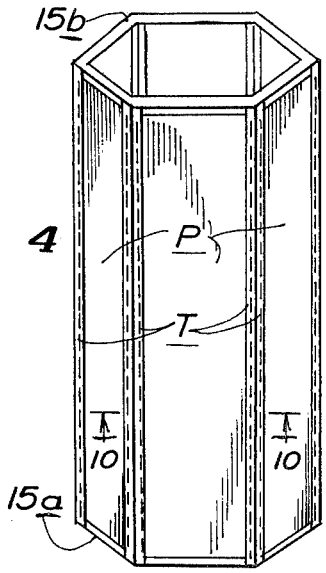

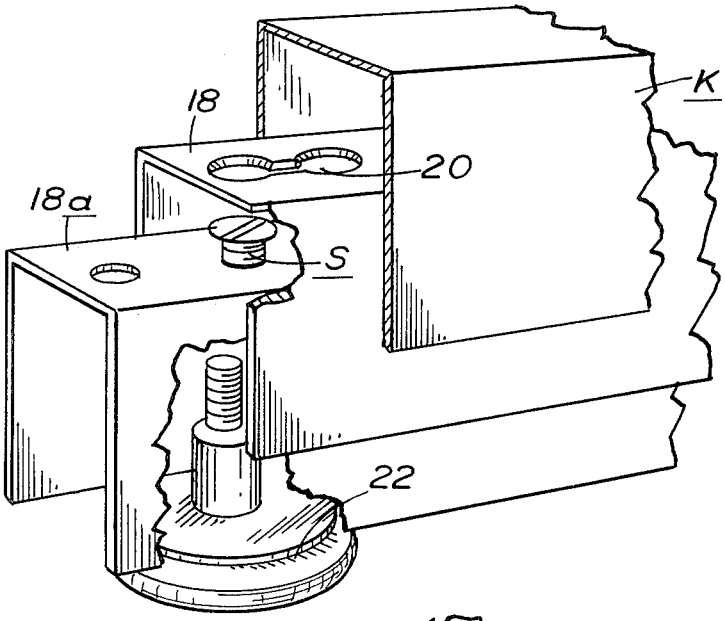
FIG. 5
FIG. 6
FIG. 8
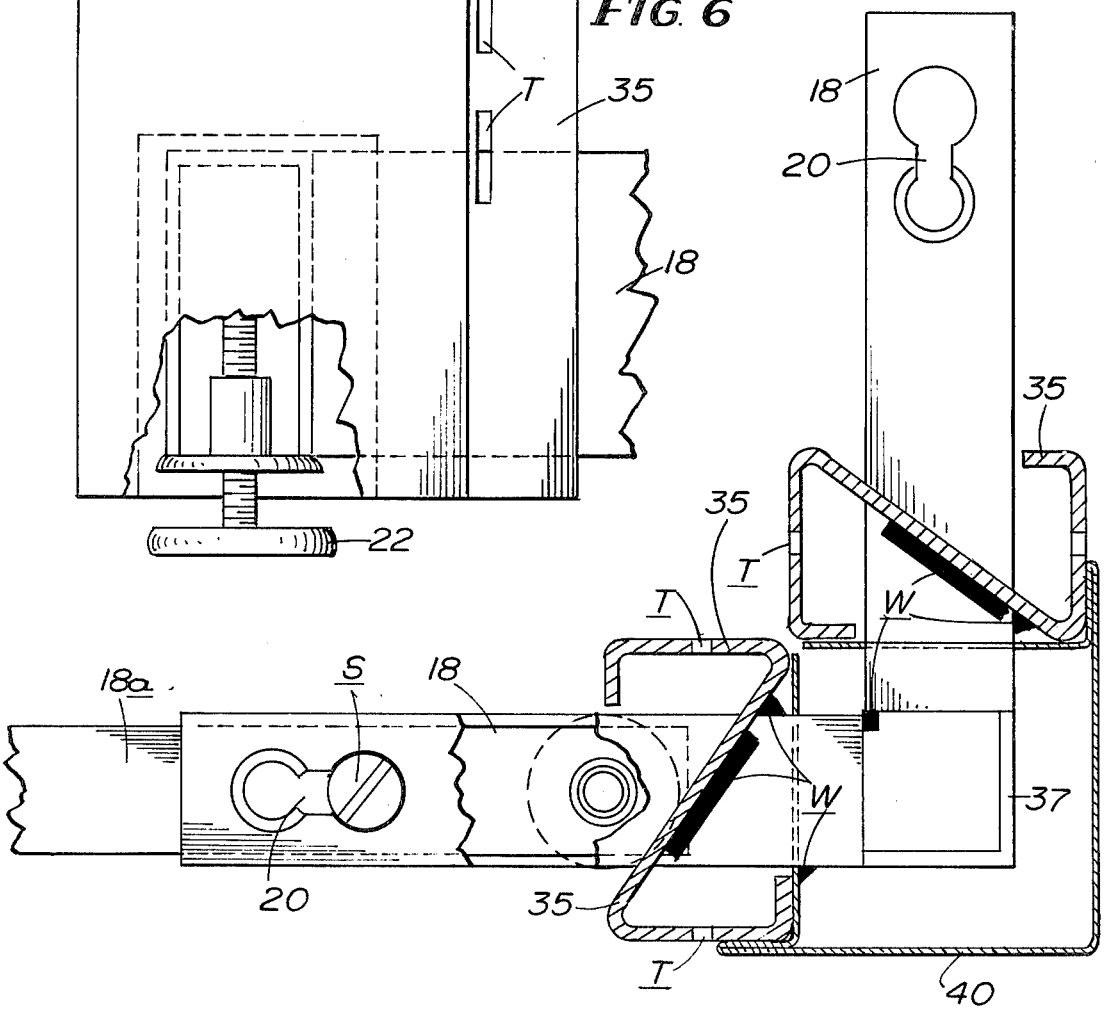

FREE STANDING WALL

My invention relates generally to merchandise display equipment for use primarily in retail merchandising establishments such as department stores, and has to do more particularly with auxiliary standing walls for attractively supporting and displaying merchandise of all sorts as well as promotional materials for same such as posters and other selling aids.

BACKGROUND

The prior art has known wall equipment for supporting and displaying merchandise as exemplified by my U.S. Pat. No. 3,101,817 dated Aug. 27, 1963. The equipment forming the subject of that patent was more or less permanently installed, being affixed to floor and ceiling "runners" from which it could be detached and then moved to different locations.

The aforesaid equipment involved considerable on-site labor in connection with installation and relocation.

More remotely pertinent is my U.S. Pat. No. 3,022,869 issued Feb. 27, 1962, disclosing and claiming wall panel structures for attachment to a permanent wall surface to provide a decorative surface.

BRIEF OUTLINE OF INVENTION

A prime object of my invention here disclosed and claimed is to provide standing wall equipment for merchandise display and the like that is free of permanent or semi-permanent attachment to any fixed structural element such as a wall, floor or ceiling or any element affixed thereto. Thus, walls embodying my invention are designed to have a high degree of mobility and be susceptible of a wide variety of arrangements to meet various display requirements.

A highly important advantage inherent in my invention is substantial reduction of on-site labor incidental to installation and relocation of the equipment, resulting in important saving of expense.

A further object is to provide such wall structures that are simple and inexpensive in design, of knock-down construction so as to be readily packed and transported in a minimum of space, easily set up and dismounted with simple hand tools and minimum of on-site labor.

Still another object is to provide a wall structure of the class described that can be formed of a minimum of largely standard structural elements, comprising essentially integral corner units to which may be detachably connected posts and stringers mainly of standard and interchangeable members, said corner units determining the general configuration of the assembled wall structure within wide limits, such as rectangular, straight line, zigzag, angular other than rectangular, etc.

A further object is to provide such a structure comprising corner units to which top and bottom stringers may be quickly attached or detached by means of simple connections such as interengageable screw-and-slot means.

Another object is to provide corner units comprising a post element and quick-detachable ornamental cover.

Various other objects and advantages will doubtless suggest themselves to those skilled in the art as the description proceeds.

BRIEF DESCRIPTION OF DRAWINGS

Referring now to the drawings showing certain preferred embodiments of my invention, FIG. 1 is a schematically drawn perspective view of such a preferred embodiment, showing a typical arrangement in zigzag formation;

FIG. 2 is a similar view showing a rectangular formation of sections embodying my invention;

FIG. 3 is a similar view with a series of panels in straight-line arrangements with a pair of transverse end panels;

FIG. 4 is a similar view with the panels disposed in polygonal formation, hexagonal in this case;

FIG. 5 is a detailed exploded perspective on an enlarged scale, with parts cut away for added clearness, and showing a bottom rail assembly with rail cover;

FIG. 6 is a fragmentary elevation of a rectangular corner assembly;

FIG. 8 is a plan-section taken substantially along line 8—8 of FIG. 7, detailing a rectangular corner unit;

DETAILED DESCRIPTION

In its broad aspects, my invention contemplates a free standing wall comprising generally a series of horizontally spaced uprights, struts or post members 10 supporting vertically spaced beams or stringers **15*a* and 15*b* attached to the respective upper and lower extremities of said posts, as shown schematically in FIGS. 1–4, inclusive, carrying display panels P**.

In general, the uprights 10 are essentially similar in construction in that they comprise one or more Z-bars for basic load-bearing support. Where such Z-bars are used in adjacent pairs, as in the corner units (see FIGS. 8–10), a decorative separable corner cover is employed, as described more in detail hereinafter.

It should be understood that uprights embodying my invention, whether at a corner or at an intermediate position between corners, are essentially integral welded units, welds being generally indicated by character W. To said units stringers are detachably connected, as hereinafter detailed, by quick-attachable-detachable means such as slot-screw combinations.

Obviously, such a structure makes for the utmost ease and speed in erecting and demounting as compared with prior wall arrangements, such as that of my prior patent above referred to, with a minimum of on-site labor.

To facilitate the mounting of panels P on and between adjacent uprights, I mount on the Z-bars longitudinally grooved channel members 48 which serve as decorative covers for the Z-bars and also provide seats for the panels, as hereinafter detailed.

Typically, stringers 15*a*, 15*b* are channel members 18, such stringers being similarly constructed at top and bottom, making for economy.

UPRIGHT UNITS

Figure 11:
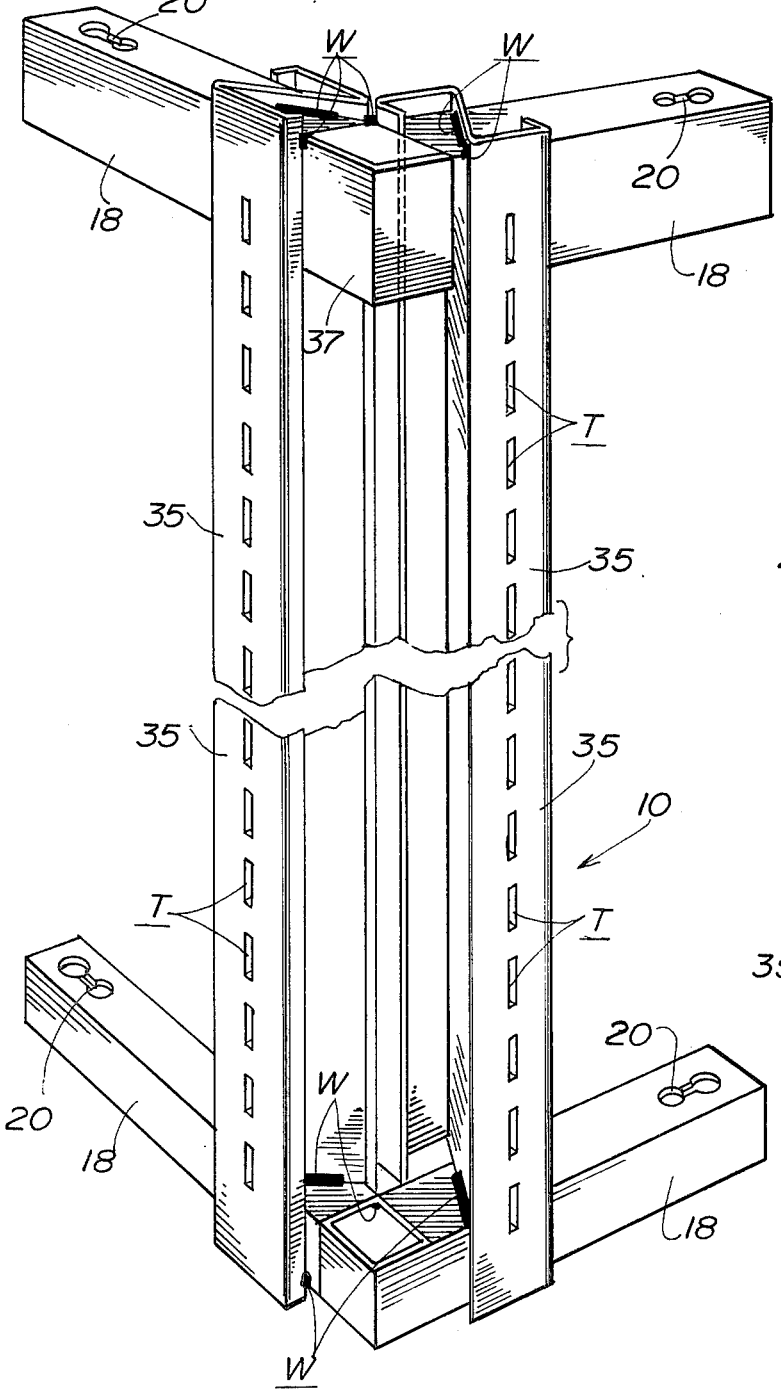
FIG. 11 is a fragmentary perspective of a rectangular corner assembly.
Figure 12:
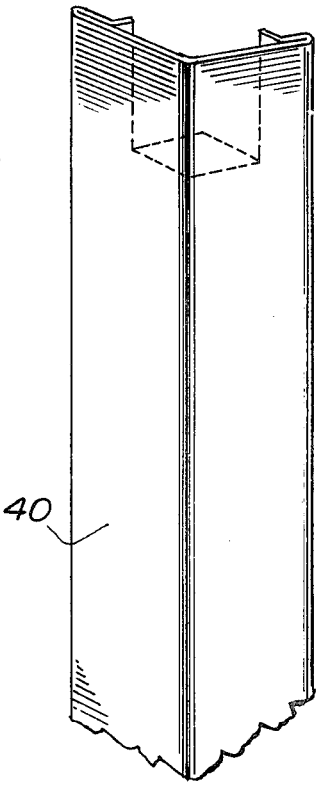
FIG. 12 is a fragmentary perspective of a cover member employed in the corner construction of FIG. 11.

Referring particularly to FIGS. 8 and 11, rectangular corner units, as employed, say, in the arrangements of FIGS. 1 and 2, are constructed as follows.

To the upper and lower ends of a pair of load-bearing structural members, preferably Z-bars 35, are affixed as by welding at W or otherwise positively securing horizontally arranged, relatively short channel sections 18, 18, said channel sections defining wall planes.

Between the two normally disposed Z-bars 35 and migwelded to the channel sections 18, to reinforce and maintain the positioning of the Z-bars and channel sections 18 at the top and bottom of the wall, are sleeve members 37 of generally rectangular cross section. Obviously, the Z-bars are cut out to permit their embracing and engaging the channel sections (and welded at such areas), said bars being slotted as at T to permit engagement with brackets for support of shelving V (FIG. 10), etc.

Channel sections 18 are provided with keyhole slots 20 or the like at top and bottom to facilitate quick attachment or detachment of channel rail members R to form the stringers. Screws S engage in said keyhole slots to secure the stringers to the corner units.

Chrome plated channel covers K may also be provided to provide decorative covers for the top and bottom stringers, said covers being removable.

Figure 7:
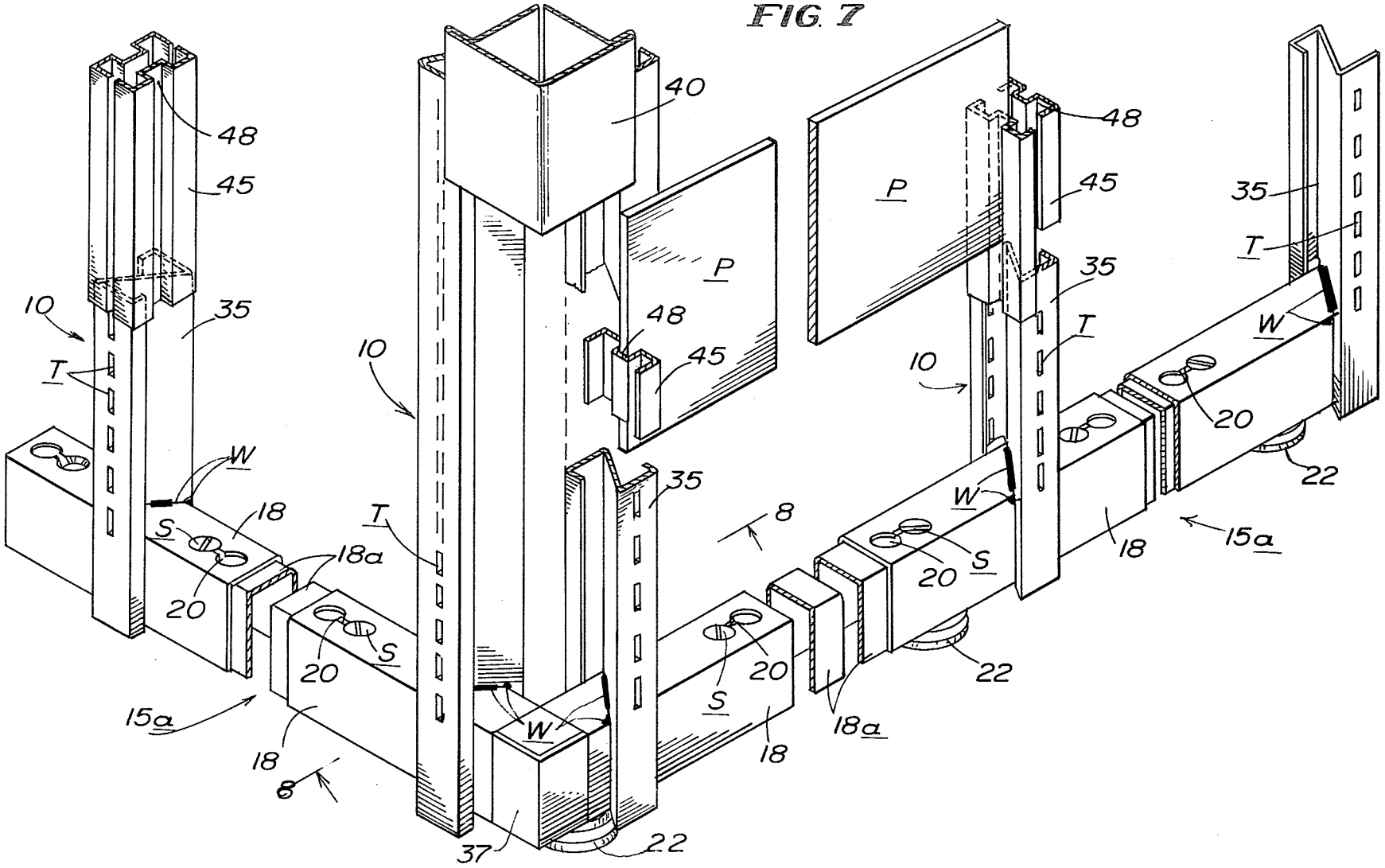
FIG. 7 is a fragmentary perspective of the lower portion of a rectangular corner unit and associated parts.

Leveling screws 22 may be provided adjacent the ends of the bottom stringers, as seen in FIGS. 5 and 7.

Also, a detachable chrome plated corner cover 40 may be snapped into the rectangular space at the corner between the Z-bars, to provide a neat, finished appearance.

The general principle of the corner unit just described may be applied to other embodiments of my invention.

Figure 10:
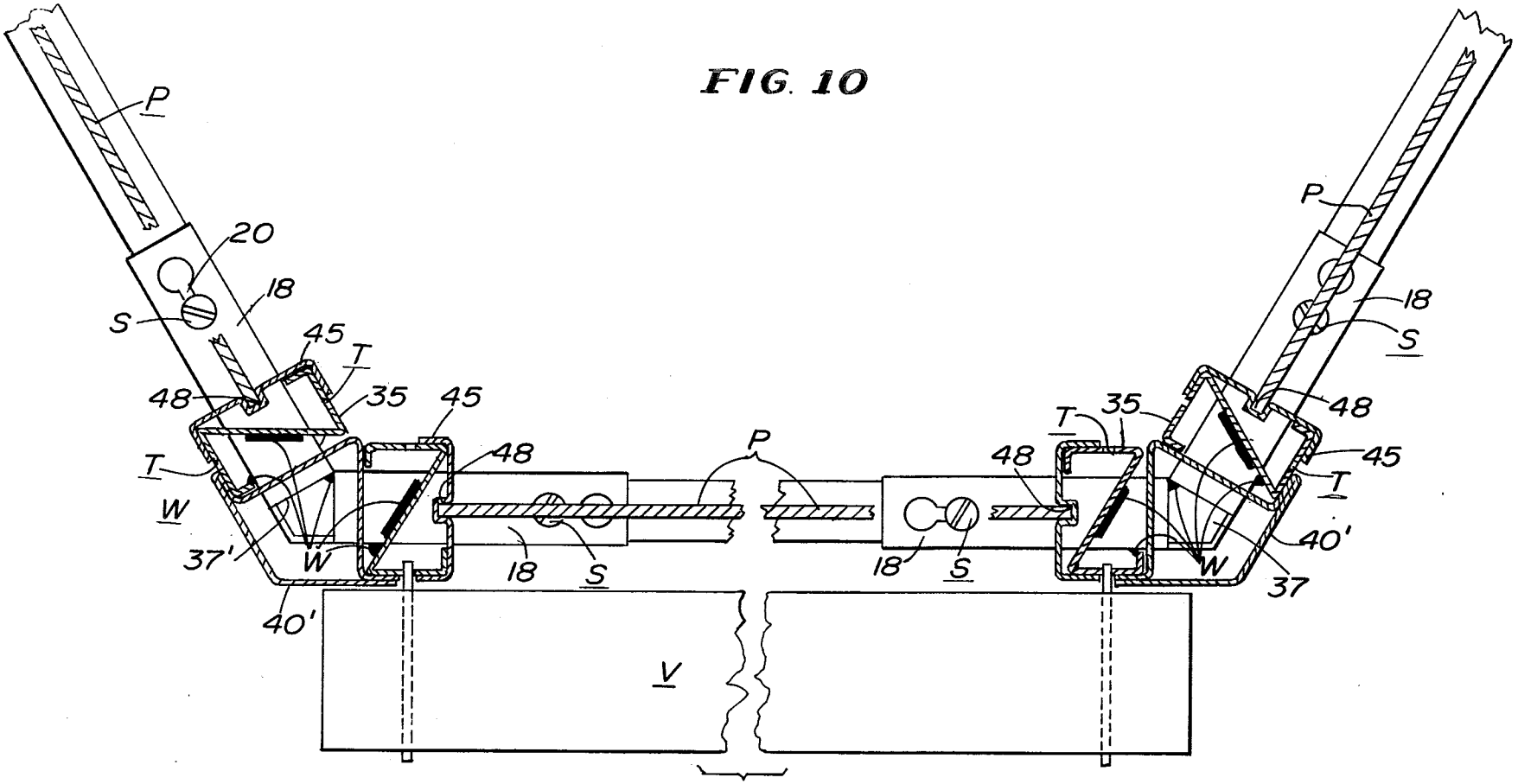
FIG. 10 is a plan-section detailing portions of a hexagonal arrangement embodying my invention, showing corner units and associated parts, as viewed along line 10—10 of FIG. 4.

Thus, referring to FIG. 10, it will be seen that in a polygonal (non-rectangular) arrangement, in this case with 60° corners, a corner unit may be provided embodying a pair of Z-bars 35 disposed vertically at the appropriate angle to provide load-bearing uprights, to which are welded, as before, channel sections at top and bottom extremities.

Generally triangular reinforcing members 37' are welded into the corners while a vertically elongated generally triangular corner cover 40', preferably chrome plated for decorative effect, may be snapped into place, similarly to cover 40 (FIG. 8).

INTERMEDIATE UPRIGHT

Figure 9:
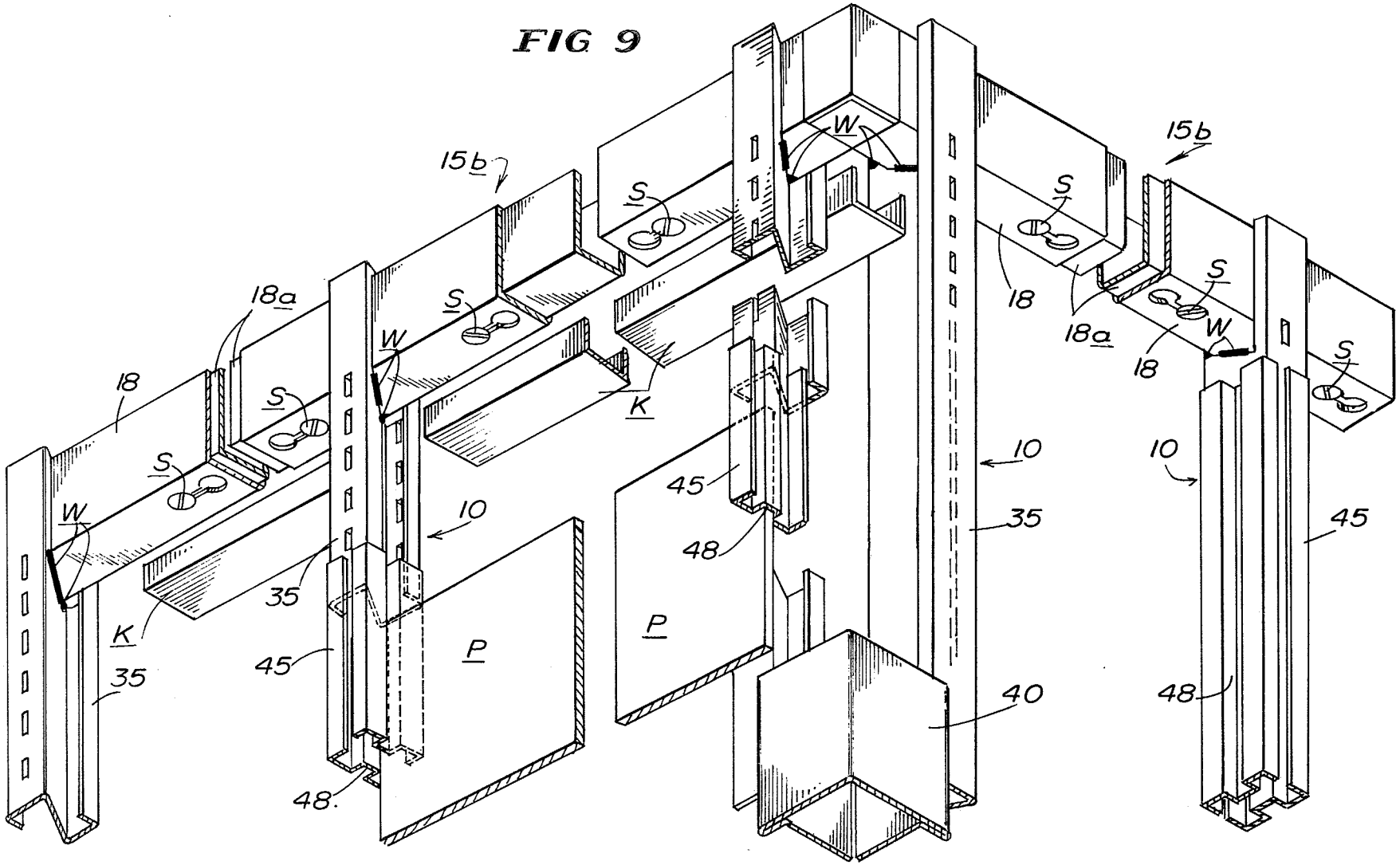
FIG. 9 is an exploded perspective of the upper portion of a rectangular corner unit and associated parts.

As seen in FIGS. 7 and 9, an intermediate upright or post 10I, as used, say, in structures such as FIGS. 1 and 3, may be provided in walls between corners, embodying substantially the same principles as described hereabove for the corner units.

That is to say, the load-bearing strut is a structural shape such as a Z-bar 35 to opposite sides of which may be secured as by welding cover members 45 shaped as a double channel having formed therein a longitudinal groove 48 for seating a display panel P between adjacent posts.

It will be understood that channel sections defining the plane of the wall are affixed to the upright at top and bottom thereof for detachably connecting the stringers, as described for the corner units.

Thus, the intermediate units serve along with the corner units for the quick erection or demounting of a wall.

Figure 15:
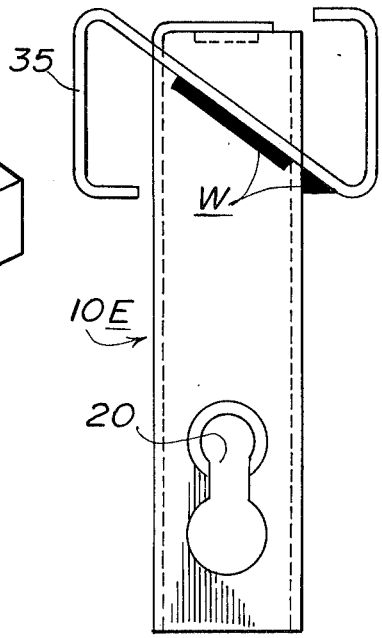
FIG. 15 is a plan-section of an end upright and its connector elements as employed, for example, in FIGS. 1 and 3.
Figure 13:
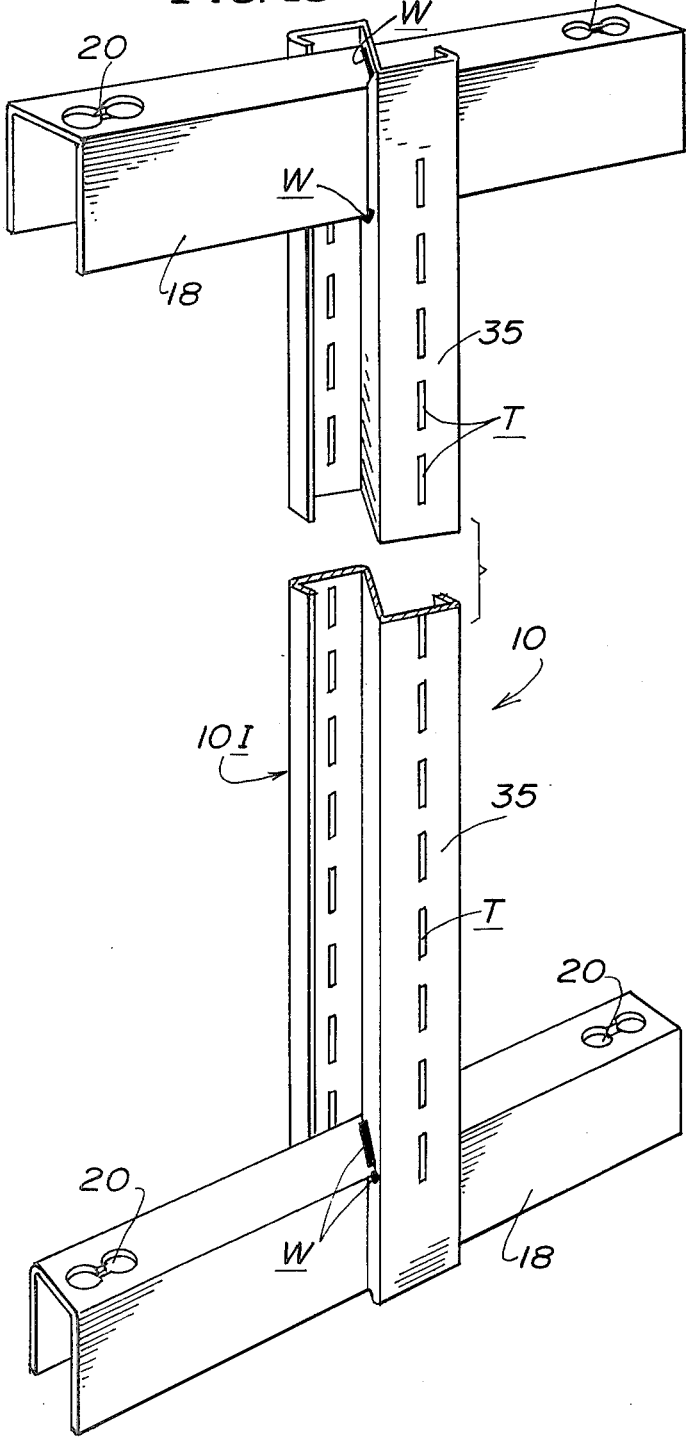
FIG. 13 is a fragmentary perspective of a mid-section upright unit forming part of a wall unit.
Figure 14:
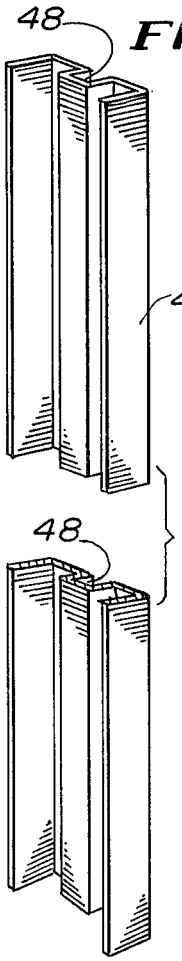
FIG. 14 is a similar view of a panel-supporting cover plate employed in the structure of FIG. 13.

Employing the same or similar principle, end uprights 10E as seen in FIGS. 1 and 3 for example, may be constructed for quick and easy mounting as detailed in FIG. 15.

CONCLUSION

It will be seen that my invention described hereabove marks a great improvement over my previously patented wall constructions, especially with regard to ease and speed of erection and demounting and great reduction of on-site labor.

Especially conducive to these ends is my provision of uprights having permanently attached transverse wall-defining elements serving as means for quick attachment of stringers. Such upright units are conveniently shipped from factory to places of use for quick erection with simple hand tools without the necessity of floor or ceiling attachment.

Various changes coming within the spirit of my invention will doubtless suggest themselves to those skilled in the art without departing from the spirit of my invention. Hence, I do not wish to be restricted to the specific forms shown or uses mentioned except to the extent indicated by the appended claims.

In special situations where a straight wall may be elongated to the extent that additional load support is desirable, certain of the uprights may be extended upwardly for attachment to the ceiling or other fixture, without departing from the spirit of my invention.

I claim:

1. A modular structural assembly comprising a vertical post having an attachment member adjacent to the upper and lower ends thereof for connecting a horizontal stringer to each member, (a) said post comprising a bar of Z-shaped cross-section having a pair of spaced parallel walls with a diagonal web extending between the laterally displaced opposite edges of said walls, and transverse flanges extending inwardly from the opposite free edges of said parallel walls, (b) each of said attachment members comprising a short horizontal channel section, having spaced vertical flanges and a horizontal intermediate web, penetrating said diagonal web and integrally connected therewith at the intersecting joint adjacent to each end of said post and having limited lengths thereof projecting from the opposite sides of said diagonal web beyond said transverse flanges, (c) at least one of said lengths having a keying aperture in the diagonal web adjacent the free end thereof, and (d) a horizontal channel member adapted to be disposed in nesting relation with respect to each of said short channel sections, and having coupling means adjacent the ends thereof for detachable engagement with the keying apertures in adjacent attachment members on the same level to form upper and lower stringers between adjacent vertical posts.

2. An apparatus as set forth in claim 1, wherein each of said attachment members has a short portion of said channel section projecting from one side of said diagonal web and a longer portion projecting from the other side thereof, and wherein said keying aperture is in the horizontal web of said longer portion.

3. An apparatus as set forth in claim 1, wherein the intersecting joint between the diagonal web and short horizontal channel section is a welded junction.

4. A plurality of modular structural units as defined in claim 1, disposed adjacent to and in alignment with each other to form the framework of a planar wall.

5. A plurality of modular structural units as defined in claim 2, disposed angularly with respect to each other and diverging from the juxtaposed short portions of said short horizontal channel sections to form the framework of angularly disposed planar walls, and a vertically extending cover between the outer walls of adjacent vertical posts and the inner juxtaposed sides of the posts adjacent to the transverse flanges for concealing the junctions between said angularly disposed attachment members.

6. An apparatus as set forth in claim 5, including a bridging member extending between the juxtaposed short portions of said horizontal channel sections to reenforce the joint therebetween.

7. An apparatus as set forth in claim 1, wherein said keying aperture is of keyhole outline and the coupling member cooperating therewith is a headed bolt in threaded engagement with the web of said last-mentioned horizontal channel member constituting the respective horizontal stringer.

8. An apparatus as set forth in claim 1, including cover members adapted to be mounted on the opposite sides of adjacent vertical posts between the parallel walls thereof, each of said members having a depressed medial guideway for retaining the opposite vertical edges of a wall panel adapted to be disposed between adjacent vertical posts.

9. An apparatus as set forth in claim 7, wherein the parallel walls of said vertical posts have a plurality of spaced vertical slots along the length thereof for the selective reception of shelf-supporting brackets therein, with said slots being clear of the cover members in engagement with said parallel walls.

10. An apparatus as set forth in claim 1, wherein the lengths of said short horizontal channel section projecting from the opposite sides of said web are substantially equal, each being provided with a keying aperture therein.

11. A modular structural assembly comprising a vertical post having an attachment member adjacent to the upper and lower ends thereof for connecting a horizontal stringer to each member, (a) said post comprising a bar having a pair of spaced parallel walls with a transverse web extending therebetween, (b) each of said attachment members comprising a short horizontal channel section having spaced vertical flanges and a horizontal intermediate web penetrating said transverse web and integrally connected therewith at the intersecting joint adjacent each end of said post and having limited lengths thereof projecting from the opposite sides of said transverse web, (b) at least one of said lengths having a keying aperture in the horizontal web adjacent the free end thereof, and (d) a horizontal channel member adapted to be disposed in nesting relation with respect to each of said short channel sections, and having coupling means adjacent the ends thereof for detachable engagement with the keying apertures in adjacent attachment members on the same level to form upper and lower stringers between adjacent vertical posts.

* * * * *